US005715756A

United States Patent [19]

Weigand et al.

[11] Patent Number: 5,715,756

[45] Date of Patent: Feb. 10, 1998

[54] RIDE ATTRACTION ANTI-ROLL BACK SYSTEM

[75] Inventors: Frank K. Weigand; Alan Black; Nick Drobnis, all of Universal City, Calif.

[73] Assignee: Universal Studios, Inc., Universal City, Calif.

[21] Appl. No.: 663,007

[22] Filed: Jun. 7, 1996

[51] Int. Cl.[6] ..... B61K 7/00

[52] U.S. Cl. ..... 104/250; 104/249; 104/252; 188/82.1

[58] Field of Search ..... 104/249, 250, 104/259, 172.4, 172.3, 146, 145, 140, 53, 59, 69, 70, 72; 188/82.1, 82.5

[56] References Cited

U.S. PATENT DOCUMENTS 5,325,790 7/1994 Drayer ..... 104/249

*Primary Examiner*—Mark T. Le

*Attorney, Agent, or Firm*—Lyon & Lyon LLP

[57] ABSTRACT

An amusement ride attraction has an anti-roll back track with stops or cross bolts covered by a continuous brush material. A vehicle such as a roller coaster car or water flume boat has an anti-roll back pawl which rides above the fiber material on skis, when the vehicle moves forward. If the vehicle begins to move backward, the skis move downwardly through the brush material and the pawl engages a stop on the track, to prevent further reverse movement. The brush material prevents the pawl from banging over each of the stops on the track, thereby reducing noise and wear.

17 Claims, 2 Drawing Sheets

RIDE ATTRACTION ANTI-ROLL BACK SYSTEM

BACKGROUND OF THE INVENTION

The field of the invention is amusement ride attractions.

Many amusement or theme park ride attractions have vehicles for carrying passengers, which are towed up an incline to a high elevation, with the vehicle then continuing throughout the ride path via gravity. The vehicle may be, for example, a roller coaster type car, or a water flume type boat. Typically, the vehicles are pulled up the incline by a continuously moving chain or cable. As a safety precaution, these types of ride attractions uniformly have braking systems to prevent a vehicle from moving in reverse down the incline, if the vehicle inadvertently releases from the towing chain or cable before reaching the crest of the incline, or if the chain or drive system fails. Such braking systems are virtually a necessity where long and steep inclines are used.

A common braking system in these applications uses a pivoting pawl on the bottom of the vehicle. As the vehicle is towed forwardly and upwardly on the incline, the pawl bumps over closely spaced apart stops. If the vehicle begins to move in reverse, the pawl engages the nearest downhill stop, thereby preventing any further reverse movement of the vehicle. As the stops are closely spaced apart, in the event of failure of the towing system, the vehicle can move only a very short distance in reverse (typically a few inches). This type of well known braking system accordingly reliably prevents the vehicle from moving down the incline uncontrolled at high speed, potentially colliding with another vehicle.

While these well known pawl and stop systems have been widely used, they tend to be very noisy, generating loud clanking sounds, as the metallic pawl bumps over each of the fixed stops. Each impact of the pawl also generates shock and vibration in the vehicle and wear on the pawls and the stops. While the noise generated on a pawl/stop system on a single vehicle on an outdoor ride attraction may be generally acceptable, it may often become unacceptable when indoors, when several vehicles are moving simultaneously on an incline, or when a reduced background noise level is necessary for passengers to reliably hear audio and sound effects. Accordingly, a quieter anti-roll back or braking system is needed for amusement ride attractions.

SUMMARY OF THE INVENTION

To these ends, an amusement ride attraction includes an anti-roll back track having stops which are preferably at least partially covered by a fiber or other penetrable material. One or more pawls are pivotally mounted to the ride attraction vehicles. The pawl advantageously rides substantially above the fiber material when moving forward and up the incline. However, if the vehicle begins to move in reverse, the pawl moves downwardly through the fiber material to engage a stop on the anti-roll back track, thereby preventing further downhill movement of the vehicle. Preferably, the fiber material is a brush material. Advantageously, the fiber or brush material is provided in two strips over the anti-roll back track, with the strips separated by a central gap. The pawl most desirably has skis on its left and right sides. The skis ride on the fiber or brush material, holding the pawl above the stops, as the vehicle moves forward. The pawl, therefore, does not bump over each stop and generate excessive noise and wear.

Accordingly, it is an object of the invention to provide an improved ride attraction.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
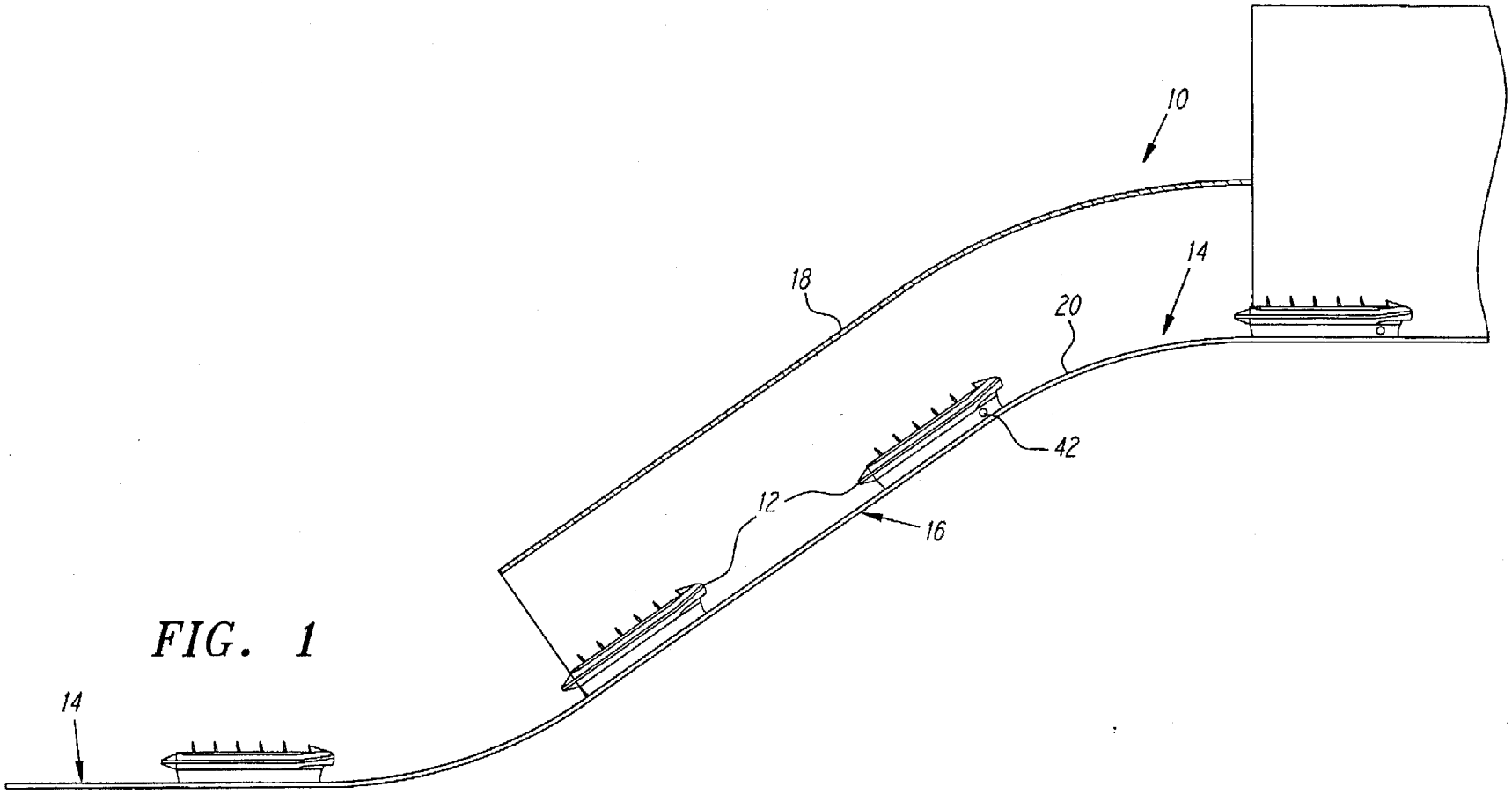
FIG. 1 is a schematically illustrated side elevation view the present ride attraction.

Turning now in detail to the drawings, as shown in FIG. 1, a ride attraction 10, includes vehicles 12 on a track or water flume path 14 extending up an incline 16. The incline section of the path may be partly or entirely within a building 18 or other surrounding structure. An anti-roll back track 20 extends entirely along the incline 16 within the track or flume path 14. A towing chain or cable (not shown) tows the vehicles 12 up the incline 16, in a well known manner.

Figure 4:
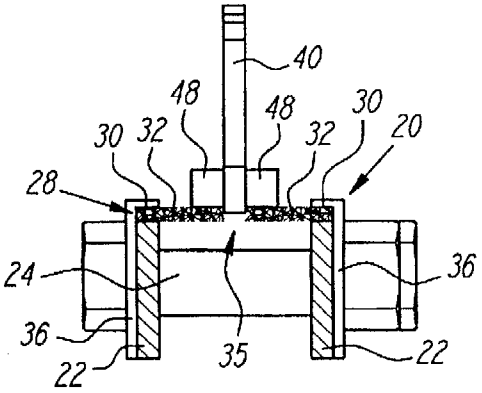
FIG. 4 is a section view taken along line 4—4 of FIG. 3.
Figure 2:
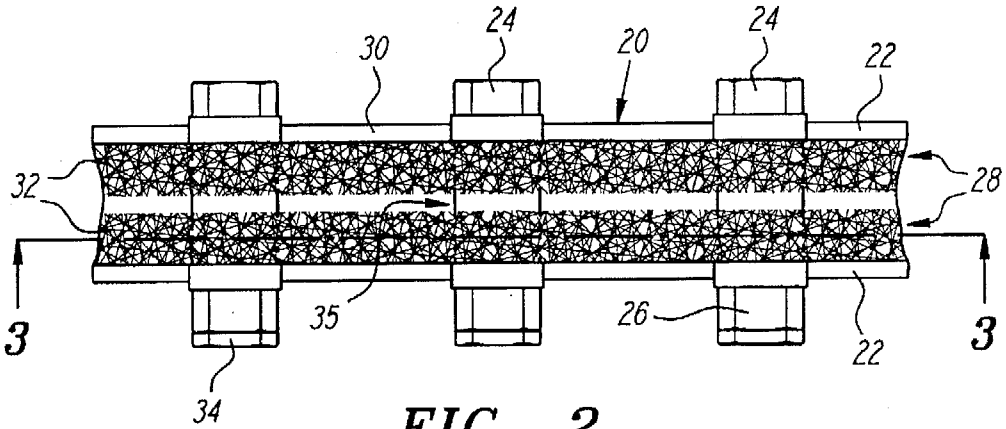
FIG. 2 is an enlarged plan view of the anti-roll back track of the ride attraction shown in FIG. 1.
Figure 3:
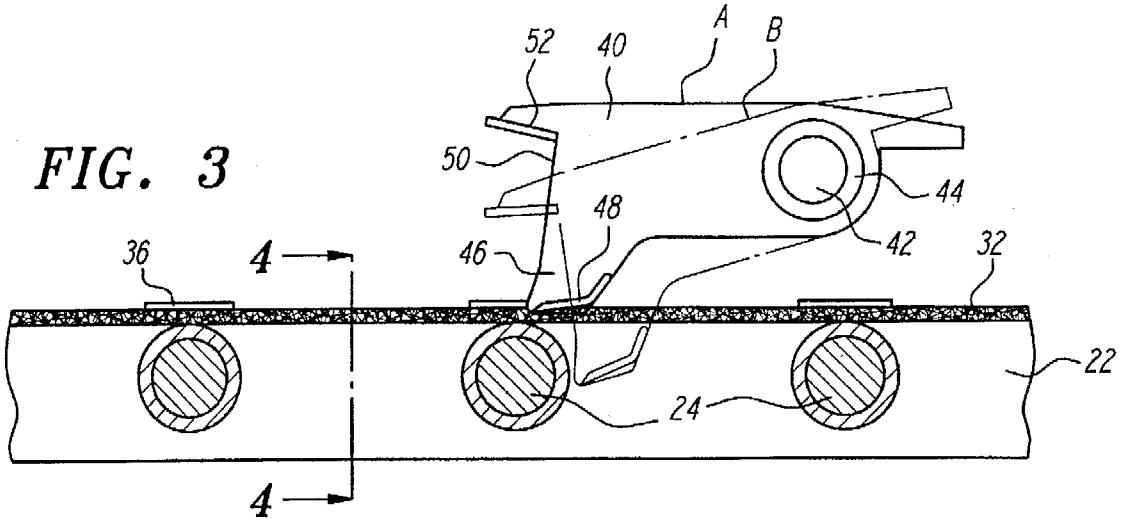
FIG. 3 is a partial section view taken along line 3—3 of FIG. 2.

Turning to FIGS. 2, 3 and 4, the anti-roll back track 20 has side rails 22 attached to a foundation or other supporting structure of the path 14. Cross bolts 24 extend through the side rails 22 at short (e.g., 6 inch) intervals and are secured in place by nuts 26 and lock nuts 34. A brush material strip 28 is provided on top of each of the side rails 22. The brush material strip 28 has a metal backing 30 crimped onto brush fibers 32. The metal backing 30 of the brush material is clamped on top of the side rails 22 by clips 36. Two opposing brush strips 28 are separated by a gap 35, as shown in FIG. 2 and 3. Alternatively, a continuous brush strip, without any gap, may be used.

Figure 5:
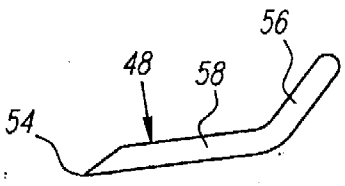
FIG. 5 is an enlarged detail of the skis on the pawl shown in FIGS. 3 and 4.

Turning to FIGS. 3, 4 and 5, a pawl 40 is mounted on a pawl shaft 42 on the boat 12 by a bearing 44. A leg 46 on the pawl 40 has brush skis 48 which extend perpendicularly outwardly on both sides of the leg 46. The pawl 40 has a flat back surface 50, and a stroke limiter 52. Surface 50 is configured to engage the cross bolts 24. The skis stop short of the flat back surface so as not to interfere with braking.

The front end of the skis 48 have an inclined front end 56 attached at an angle to the body 58 of the ski 48, as shown in FIG. 5. The back end of the skis has a forwardly inclining angle (preferably about 30 degrees) terminating at the back of the ski in a relatively sharp edge 54. The brush strip 28 extends generally entirely over the length of the track 20, i.e, the full length of the tow chain.

In use, referring to FIGS. 3 and 4, as the vehicle 12 moves forward up the incline 16, the brush skis 48 ride on top of the brush fibers 32. The sliding movement of the metal (e.g., steel) or plastic skis on the brush fibers generates no significant noise. As shown in FIG. 3, with the vehicle moving forward, the body 58 of each ski 48 is generally flush or flat against and parallel to the plane of the brush material. Alternatively, the skis may be set to ride at a slightly inclined angle. The skis 48 riding on the brush material 32 hold the pawl 40 (and the pawl leg 46) above the level of the cross bolts 24. Accordingly, the pawl does not contact or bump over the cross bolts as the vehicle moves forward. This eliminates the banging or clanking noise characteristic of this type of ride attraction anti-roll back or braking systems.

When used indoors, or where several vehicles ascend an incline simultaneously, as shown in FIG. 1, the noise and wear reduction is significant, allows for improved use of sound effects, reduces shock and vibration, and provides an overall improved ride attraction experience.

Referring once again to FIGS. 3 and 4, if the towing system fails and a vehicle 12 begins to move in reverse, the angled rear edge 54 of the brush skis 48 is pushed downwardly, from position A in FIG. 3, through the brush fibers 32, allowing the pawl 40 to engage a cross bolt 24, to position B in FIG. 3, thereby stopping the vehicle 12. The brush skis 48 move downwardly through the brush material due to forces resulting from the weight and geometry of the pawl and the rearward movement of the vehicle. When the vehicle begins to move forward again, the skis are pushed up through the brush material as the pawl rides over the first stop encountered. The pawl then remains above the brush material and the stops or bolts 24, unless the vehicle again moves in reverse. If the brush strip wears out, or is damaged, the ride attraction operates as in a conventional anti-roll back system, with the pawl bumping over the stops. The anti-roll back function then continues, but without the advantages described above.

The invention may be used on water flume/boat rides, as shown and described above, and also on various other rides, such as roller coasters, etc. Various equivalent materials may be substituted for the brush and ski materials. Similarly, the configuration of the brush material shown, the pawl, the brush skis, and cross bolts may also be readily modified, and equivalents of them used in their places, while still obtaining the advantages of the invention. Thus, a novel ride attraction has been shown and described. Various changes may of course be made without departing from the spirit and scope of the present invention. The invention, therefore, should not be restricted, except by the following claims.

We claim:

1. An amusement ride attraction comprising:

an anti-roll back track including stops at least partially covered by fiber material; and a vehicle having an anti-roll back pawl which rides substantially above the fiber material when moving forward, and which moves through the fiber material to engage a stop on the anti-roll back track, when the vehicle moves in reverse.

2. The amusement ride attraction of claim 1 wherein the fiber material comprises a brush material.

3. The amusement ride attraction of claim 1 further comprising at least one ski on the pawl.

4. The amusement ride attraction of claim 1 further comprising a leg on the pawl with a pair of skis projecting generally perpendicularly from the leg.

5. The amusement ride attraction of claim 1 wherein the anti-roll back track includes two strips of the fiber material separated by a central gap.

6. The amusement ride attraction of claim 5 wherein the pawl on the vehicle has a leg in the central gap, and at least one ski on the leg.

7. The amusement ride attraction of claim 3 wherein the ski has an upturned front end.

8. The amusement ride attraction of claim 3 wherein the ski has a forwardly inclining trailing edge.

9. An anti-roll back track system having a pawl on a vehicle and spaced apart stops on a track, comprising:

a fiber material over the track for holding the pawl above the stops during forward movement of the vehicle and for allowing the pawl to drop down and engage a stop during rearward movement of the vehicle.

10. An amusement ride attraction comprising:

a track including stops;

a strip of material supported over the stops; and a vehicle having a pawl which rides on the strip of material when moving forward, and which drops down below the strip of material to engage a stop on the track, when the vehicle moves in reverse.

11. The amusement ride attraction of claim 10 wherein the strip of material comprises a brush material.

12. The amusement ride attraction of claim 10 further comprising at least one ski on the pawl.

13. The amusement ride attraction of claim 10 further comprising a leg on the pawl with a pair of skis projecting generally perpendicularly from the leg.

14. The amusement ride attraction of claim 10 wherein the track includes two strips of material separated by a central gap.

15. The amusement ride attraction of claim 14 wherein the pawl on the vehicle has a leg in the central gap, and at least one ski on the leg.

16. The amusement ride attraction of claim 12 wherein the ski has an upturned front end.

17. The amusement ride attraction of claim 12 wherein the ski has a forwardly inclining trailing edge.

* * * * *